US007187131B2

(12) United States Patent
Budinger

(10) Patent No.: US 7,187,131 B2
(45) Date of Patent: Mar. 6, 2007

(54) DISCHARGE LAMP WITH INTERNAL STARTING ELECTRODE

(75) Inventor: A. Bowman Budinger, Westford, MA (US)

(73) Assignee: Osram Sylvania Inc., Danvers, MA (US)

( * ) Notice: Subject to any disclaimer, the term of this patent is extended or adjusted under 35 U.S.C. 154(b) by 0 days.

(21) Appl. No.: 11/011,390

(22) Filed: Dec. 14, 2004

(65) Prior Publication Data

US 2006/0125404 A1 Jun. 15, 2006

(51) Int. Cl.
*H01J 17/44* (2006.01)
*H01J 61/54* (2006.01)

(52) U.S. Cl. ..... 315/82; 315/581; 315/595; 313/601; 313/607; 313/303

(58) Field of Classification Search ..... 325/82, 325/56; 315/246, 291, 194, 82, 112; 313/578, 313/594, 581, 595, 601
See application file for complete search history.

(56) References Cited

U.S. PATENT DOCUMENTS

| | | | | |
|---|---|---|---|---|
| RE32,626 E | | 3/1988 | Yoshizawa et al. | 315/39 |
| 4,734,612 A | * | 3/1988 | Sasaki et al. | 313/15 |
| 5,064,395 A | * | 11/1991 | Kling et al. | 445/27 |
| 5,510,967 A | * | 4/1996 | Coushaine et al. | 362/261 |
| 5,990,633 A | | 11/1999 | Hirschmann | 315/289 |
| 6,445,129 B1 | * | 9/2002 | Seiler et al. | 313/594 |
| 6,626,079 B1 | | 9/2003 | Golkowski et al. | 315/39.51 |
| 6,661,171 B2 | | 12/2003 | Hecker | 313/594 |
| 6,661,184 B2 | | 12/2003 | Okamoto et al. | 315/289 |
| 6,750,612 B2 | * | 6/2004 | Takagaki et al. | 313/634 |
| 6,906,462 B1 | * | 6/2005 | Gorille | 313/607 |
| 2002/0057058 A1 | * | 5/2002 | Honda et al. | 313/578 |
| 2003/0034738 A1 | * | 2/2003 | Kanegae et al. | 315/56 |

* cited by examiner

*Primary Examiner*—Tho Phan
*Assistant Examiner*—Chuc Tran
(74) *Attorney, Agent, or Firm*—Carlo S. Bessone

(57) ABSTRACT

An arc discharge light source (10) for automotive headlight applications comprises an arc tube (12) having a hollow body (14) arrayed along a longitudinal axis (16) and provided with first and second ends (18, 20). The first and second ends have, respectively, first and second jointure areas (22, 24) with the hollow body (14). Electrodes (26, 28) are sealed respectively in each of the first and second ends (18, 20). An arc generating and sustaining medium is contained within the hollow body. a low-voltage-pulse starting aid (30) is associated with the arc tube and comprises an electrically conductive member (32) having an intermediate portion (34) and proximal and distal ends (36, 38). The intermediate portion (34) extends the length of the hollow body (14) and the proximal and distal ends (36, 38) each terminating in a loop (40, 42) comprised of a single turn of electrically conductive material. The loop (40) from the proximal end (36) surrounds the first jointure area (22) and the loop (42) from the distal end (38) surrounds the second jointure area (24).

4 Claims, 3 Drawing Sheets

DISCHARGE LAMP WITH INTERNAL STARTING ELECTRODE

TECHNICAL FIELD

This invention relates to high intensity discharge lamps and more particularly to starting aids for such lamps.

BACKGROUND ART

High intensity discharge (HID) lamps typically require the application of a starting voltage or ignition voltage that is substantially higher than the operating voltage of the lamp. This starting voltage must provide a sufficiently higher electric field, such that, in the presence of an avalanche-initiating electron, breakdown will occur. It is well know to those skilled in the art that igniting HID lamps can be difficult, especially in lamps using high buffer gas pressures, in mercury-free lamps or in re-start situations after a lamp has recently been extinguished.

Many attempts have been made to improve the starting of HID lamps. For example, some ignition aids improve the starting performance by assuring the presence of an avalanche-initiating electron. Specifically, the use of UV enhancers and Krypton-85-containing buffer gases are well known. Other methods and devices are intended to enhance the local electric field in the region between the electrodes (or in the discharge volume for electrodeless lamps). Another method of aiding the initiation of a discharge involves increasing the electric field at a give externally applied voltage. It is to the latter category that the instant invention pertains.

Typically, such field enhancement is accomplished by the addition of an electrically conductive member such as a wire or metallized stripe, which reduces the effective arc gap between the electrodes, thus leading to a lower breakdown voltage. The conductor can be floating, as in the case of high pressure sodium lamps, (see, for example, U.S. Pat. No. 6,661,171), or the conductor can be electrically coupled to one of the electrodes. Connection to one of the electrodes introduces an undesirable influence on sodium migration in the case of metal halide or sodium lamps, so a bimetal switch typically is employed to disconnect the starting aid from the electrode as the lamp heats up.

In electrodeless lamps, it has been suggested to embed a conductor into the quartz envelope to provide field enhancement (see, for example, U.S. Pat. No. Re 32,626). The deposition of a matrix coating of conductive and/or semi-conductive fibers has also been suggested to facilitate starting. The deposition can be internal or external and, if internal, it is suggested that the fibers be coated with a sol gel-deposited silica coating to protect the fibers from the plasma environment (see U.S. Pat. No. 6,628,079).

While the above methods have had success in the various large lamps currently in use, the problems of starting high-pressure discharge lamps for automotive headlamps, which require instant on status, are somewhat different.

The conventional approach to assuring instant ignition of high pressure automotive headlamps is to over-voltage the ignition pulse, allowing breakdown to occur with the first or at least the first few ignition pulses to be applied to the lamp by the ballast. This often requires a rapid stream of ignition pulses with peak pulse heights of 20 to 25 kV. The overall goal has been to match the "turn on" speed of conventional halogen incandescent lamps.

Conventional high pressure lamp ballasts, such as those shown in U.S. Pat. No. 6,661,184, apply high voltage starting pulses directly through the two main arc tube electrodes. In addition, the main drive circuitry delivers the sustaining current waveforms directly through the secondary windings of the ignitor step-up transformer. This approach has definite disadvantages from the standpoint of size and heat dissipation. Heavy gauge wire has to be used in the secondary windings to handle the current capacity of the drive circuit. This has the added disadvantage of making the secondary winding rather large, which is a definite drawback for automotive headlamp applications, where it is desired that the lighting systems be as small as possible.

It is known that increasing the frequency of the drive circuitry can significantly reduce ballast size. Higher drive frequency means reduced sizes of some components, mainly those of the inductive components. Unfortunately, the inductance of the secondary windings of the ignitor circuit inhibits the passage of high frequency and prohibits the use of this type of ballast.

An alternative ballast design that eliminates the shortcomings described above is taught by U.S. Pat. No. 5,990,633 to Hirschmann. Therein, the functions of ignition and drive are separated. This is achieved by the use of a third lamp ignition electrode. High voltage pulses are applied from the secondary windings of the ignitor transformer. The ignitor secondary winding is totally removed from the drive circuit in this case and as a result allows for a smaller ignitor transformer, less heat dissipation and higher frequency of operation.

The '633 patent described above teaches that the auxiliary ignition electrode be a thin metallic coating in the form of an elongated strip which extends from the base of the bulb to approximately the center point of the discharge vessel, with the result that the end of the auxiliary electrode remote from the base is approximately the same distance from both electrodes. Also suggested is the use of a thin wire which extends parallel to the longitudinal axis of the lamp or which is looped around the discharge.

It would be an advance in the art if an electrode starting probe could be developed that utilized lower voltage pulse heights from the ignitor.

DISCLOSURE OF INVENTION

It is, therefore, an object of the invention to obviate the disadvantages of the prior art.

It is another object of the invention to enhance starting probes for high pressure automotive headlamps.

Still another object of the invention is the provision of probe designs that can be utilized both on the outside of the arc tube or the outside of an outer envelope enclosing the arc tube.

These objects are accomplished, in one aspect of the invention, by an arc discharge light source for automotive headlight applications including an arc tube having a hollow body arrayed along a longitudinal axis and provided with first and second ends. The first and second ends have, respectively, first and second jointure areas with the hollow body An electrode is sealed in each of the first and second ends and an arc generating and sustaining medium is contained within the hollow body. A low-voltage-pulse starting aid is associated with the arc tube. The low-voltage-pulse starting aid comprises an electrically conductive member having an intermediate portion and proximal and distal ends. The intermediate portion extending the length of the hollow body and the proximal and distal ends each terminate in a loop comprising at least one turn of electrically conductive material. The loop from the proximal end surrounds the first jointure area and the loop from the distal end surrounds the second jointure area.

It has been discovered that for this embodiment both components, i.e., the loop around each arc tube neck and the continuous conductive path from the area of one electrode to the other, are critical to low voltage breakdown.

An alternate embodiment is also disclosed wherein an arc discharge light source for automotive headlight applications includes an arc tube having a hollow body arrayed along a longitudinal axis and provided with first and second ends. An electrode is sealed in each of the first and second ends. Each of the electrodes have an interior portion extending into the interior of the hollow body and together define an arc gap with a given distance and an exterior portion extending outside of the arc tube. An arc generating and sustaining medium is contained within the hollow body. A transparent shield surrounds the arc tube. At least a part of the exterior portions of the electrodes exit the shield in a manner to allow connection to an operating circuit. A low-voltage-pulse starting aid is affixed to the shield in a position opposite the arc gap. The low-voltage-pulse starting aid is electrically conductive and has a longitudinal dimension greater than the arc gap.

BEST MODE FOR CARRYING OUT THE INVENTION

For a better understanding of the present invention, together with other and further objects, advantages and capabilities thereof, reference is made to the following disclosure and appended claims taken in conjunction with the above-described drawings.

Figure 1:
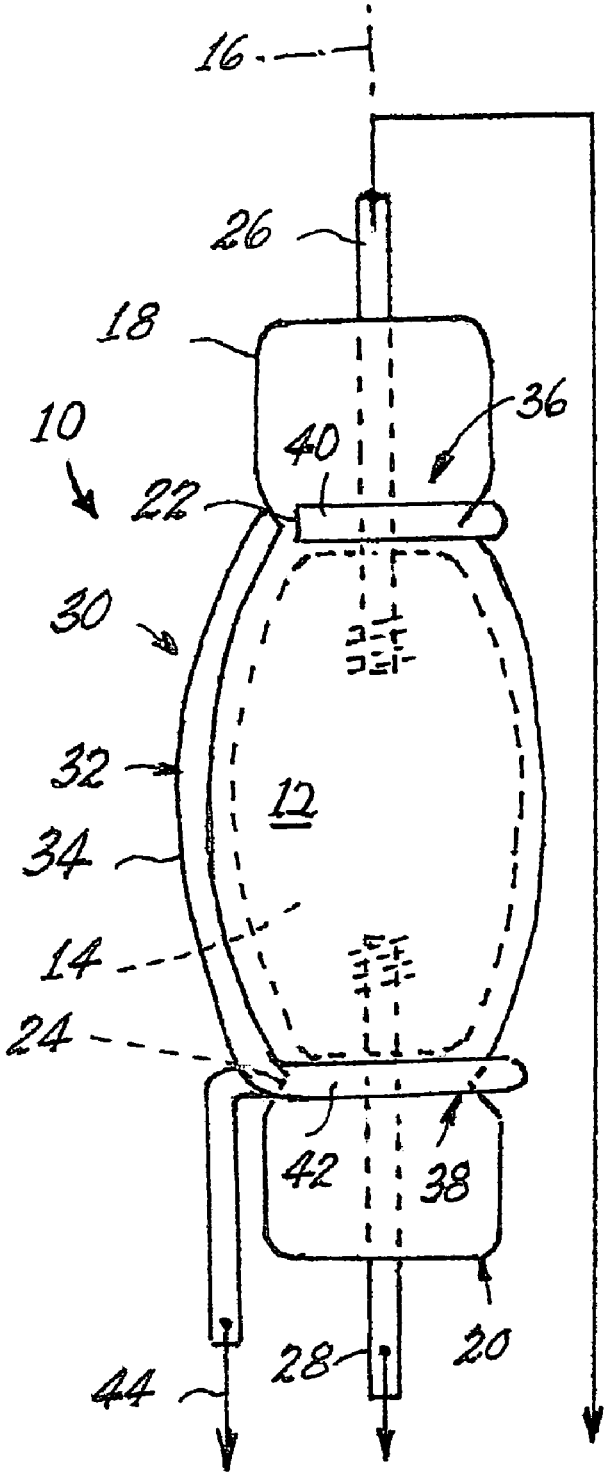
FIG. 1 is an elevational view of an embodiment of the invention.

Referring now to the drawings with greater particularity, there is shown in FIG. 1 an arc discharge light source 10 for automotive headlight applications that has an arc tube 12 having a hollow body 14 arrayed along a longitudinal axis 16 and provided with first and second ends 18, 20. The first and second ends have, respectively, first and second jointure areas 22, 24 where they connect with the hollow body 14.

Electrodes 26, 28 are sealed respectively in each of the first and second ends 18, 20 and an arc generating and sustaining medium, as is known, is contained within the hollow body.

A low-voltage-pulse starting aid 30 is associated with the arc tube 12 and comprises an electrically conductive member 32 having an intermediate portion 34 and proximal and distal ends 36, 38. The intermediate portion 34 extends the length of the hollow body14 and the proximal and distal ends 36, 38 each terminate in a loop 40, 42 comprised of at least one turn of electrically conductive material. The loop 40 from the proximal end 36 surrounds the first jointure area 22 and the loop 42 from the distal end 38 surrounds the second jointure area 24.

A circuit-connecting means 44 is in electrical communication with the low-voltage-pulse starting aid.

Figure 3:
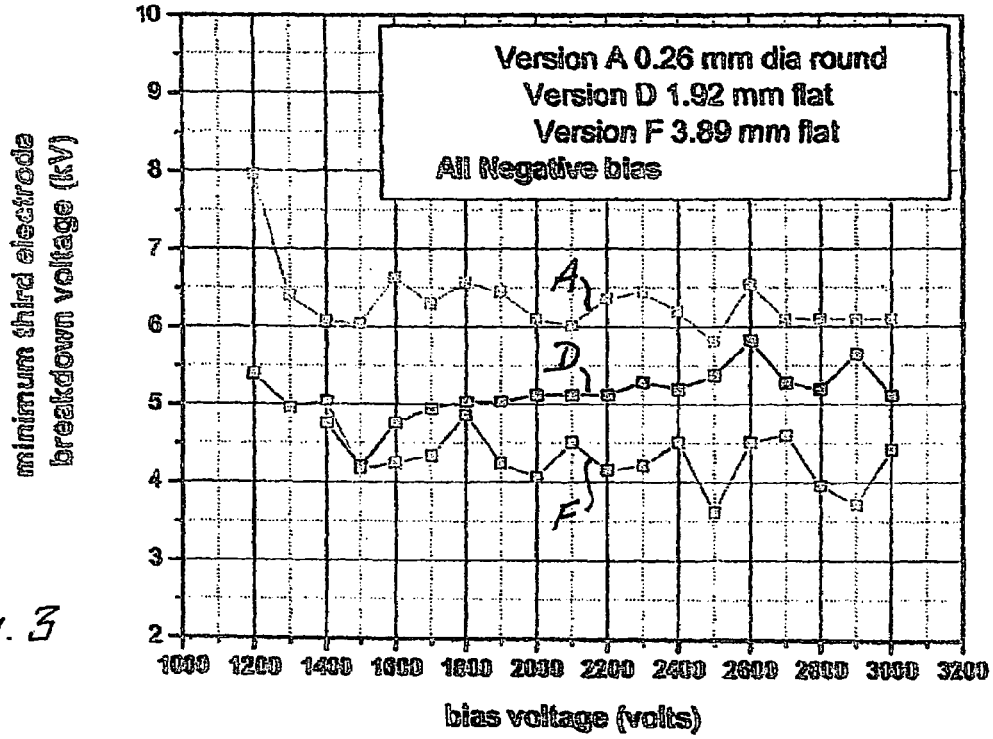
FIG. 3 is a graph of minimum starting aid pulse breakdown voltage as a function of arc tube bias for different starting aid sizes.
Figure 4:
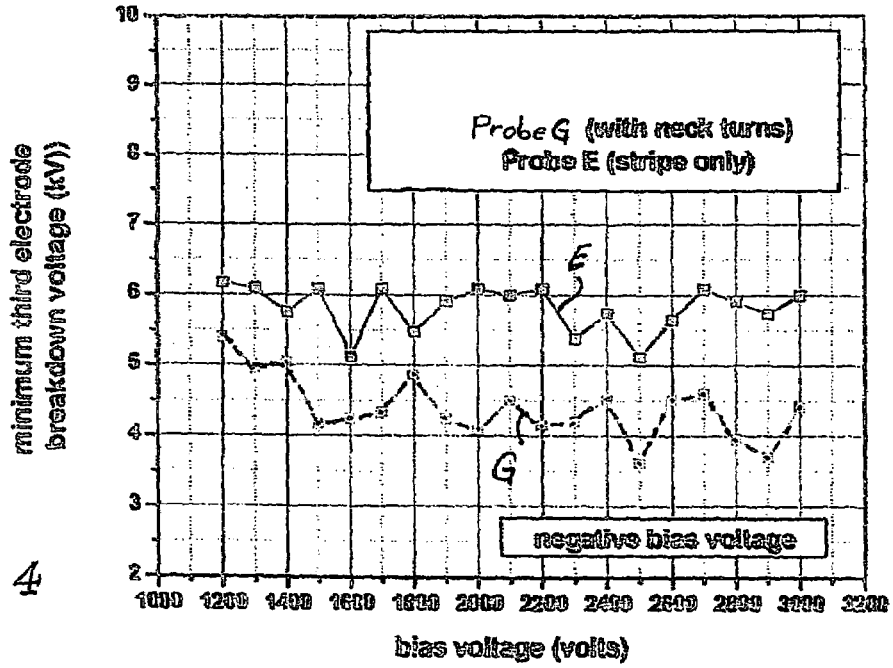
FIG. 4 is a graph minimum starting aid pulse breakdown voltage with and without neck loops.

The width of the starting aid 30 is a major factor in determining the aid pulse breakdown voltage, as is shown in FIG. 3. It is clear from the graph that the wider the starting aid the more reduction in breakdown voltage is achieved; however, the upper limit on starting aid width will necessarily be determined by the optical performance required by the lamp. In all of the instances shown in FIG. 3 the neck loops were always round wire with a diameter of 0.28 mm. Other wire diameters and cross sections can be used. FIG. 3 also shows the minimum starting aid voltage breakdown as a function of bias on one of the two main electrodes. From this it can be seen that a minimum main bias voltage of about 1400 volts is necessary to reproducibly achieve low voltage breakdown. In one embodiment, breakdown could not be achieved at main bias voltage less than 1200 volts regardless of the magnitude of the starting aid breakdown pulse. The addition of the neck loops clearly plays a role in reducing the starting aid breakdown voltage as shown in FIG. 4, wherein an approximately 1.5 kV decrease in breakdown voltage occurs when the neck loops are added.

Figure 2:
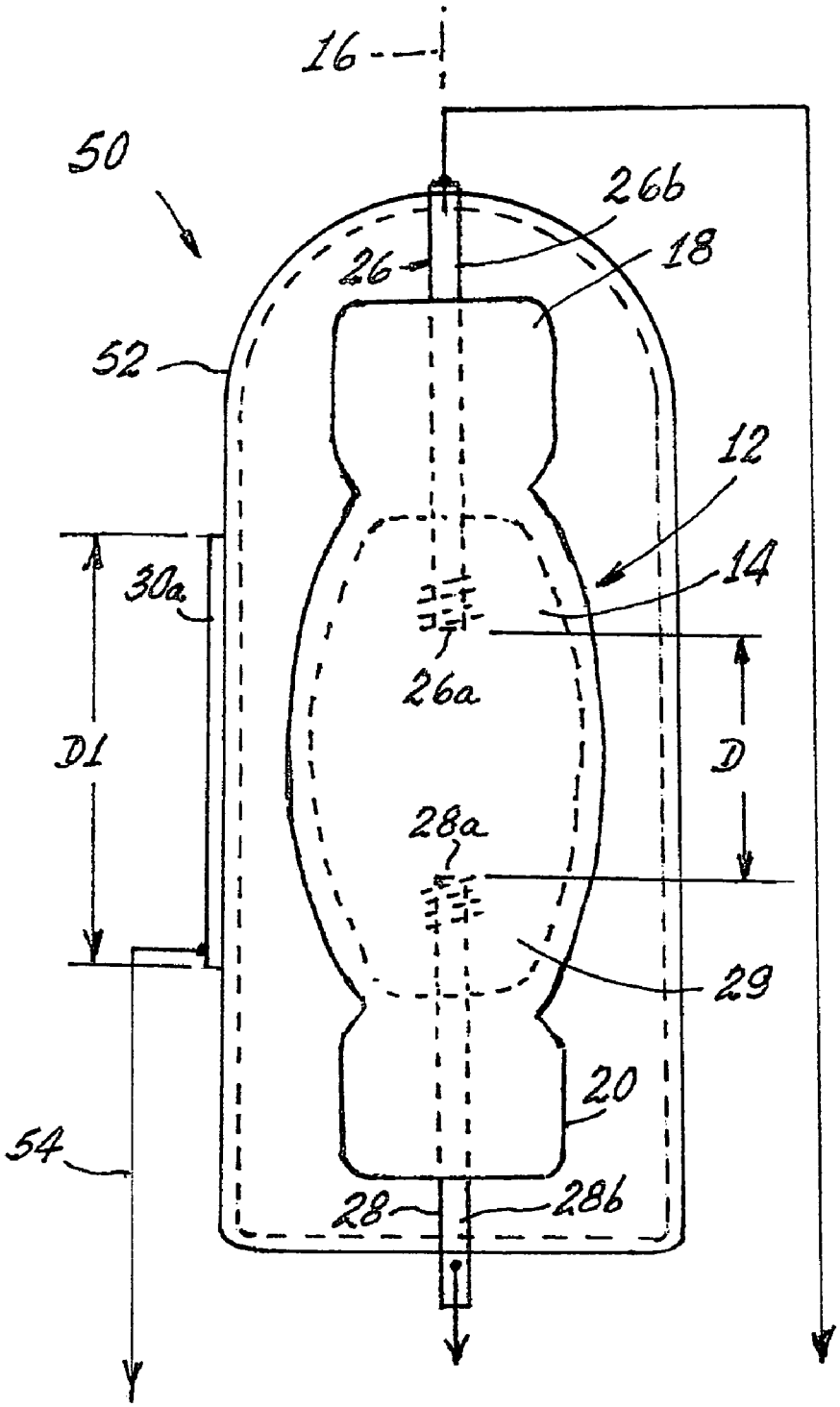
FIG. 2 is an elevational view of an alternate embodiment of the invention.

Referring now to FIG. 2 it will be seen that an arc discharge light source 50 for automotive headlight applications can comprise an arc tube 12 having a hollow body 14 arrayed along a longitudinal axis 16 and provided with first and second ends 18, 20. Electrodes 26, 28 are sealed respectively in each of the first and second ends 18, 20, each of the electrodes 26, 28 having an interior portion 26*a*, 28*a* extending into the interior 29 of the hollow body 14 and together defining an arc gap D with a given distance, and an exterior portion 26*b*, 28*b* extending outside of the arc tube 12. Exterior portion 26*b*, 28*b* of electrodes 26, 28 are covered with an insulator (i.e., glass). An arc generating and sustaining medium is contained within the hollow body 14.

In this embodiment a transparent shield 52 surrounds the arc tube 12 and at least a part of the exterior portions 26*b*, 28*b* of the electrodes 26, 28 exit the said shield 52 in a manner to allow connection to an operating circuit. Transparent shield 52 contains a fill of an inert gas comprised, for example, of nitrogen, argon, xenon, neon, krypton and/or mixtures thereof. The preferred embodiment has a fill pressure of one atmosphere but other pressure levels can also be used. Upon breakdown, a barrier discharge between the inner surface of shield 52 and the outer surface of arc tube 12 causes charge to be formed on the inner surface of 12 which in turn enhances the field between 26*a* and 28*a* facilitating the desired main breakdown between these two electrodes.

A low-voltage-pulse starting aid 30*a* is affixed to the shield 52 in a position opposite the arc gap and the low-voltage-pulse starting aid 30*a* is electrically conductive and has a longitudinal dimension D1 greater than the arc gap D. In a preferred embodiment, the longitudinal dimension of aid 30*a* extends at least 5 mm beyond each electrode.

The low-voltage-pulse starting aid 30*a* has at least one electrical connection 54 to an operating circuit (not shown).

As with the previous embodiment, tests have shown that a wider width for the starting aid continues a trend toward lower breakdown voltage. In this regard it is possible to construct the starting aid of a transparent electrically conductive material, such as tin oxide or indium-tin oxide without seriously affecting the optical performance of the lamp. In such a case of a transparent electrode on the shield or outer jacket of the lamp the size would be limited only by arcing considerations to the return lead or arc tube base.

Thus there is here provided an arc tube suitable as a headlamp for an automobile having a lower starting pulse than was heretofore available.

While there have been shown and described what are present considered to be the preferred embodiments of the invention, it will be apparent to those skilled in the art that various changes and modifications can be made herein without departing from the scope of the invention as defined by the appended claims.

What is claimed is:

1. An arc discharge light source for automotive headlight applications comprising:

an arc tube having a hollow body arrayed along a longitudinal axis and provided with first and second ends, said first and second ends having, respectively, first and second jointure areas with said hollow body;

an electrode sealed in each of said first and second ends and an arc generating and sustaining medium contained within said hollow body; and a low-voltage-pulse starting aid associated with said arc tube, said low-voltage-pulse starting aid comprising an electrically conductive wire member having an intermediate portion and proximal and distal ends, said intermediate portion extending the length of said hollow body and said proximal and distal ends each terminating in a loop comprised of at least one turn of electrically conductive wire, said loop from said proximal end surrounding said first jointure area and said loop from said distal end surrounding said second jointure area.

2. The arc discharge light source of claim 1 wherein a circuit-connecting means is in electrical communication with said low-voltage-pulse starting aid.

3. An arc discharge light source for automotive headlight applications comprising:

an arc tube having a hollow body arrayed along a longitudinal axis and provided with first and second ends, said first and second ends;

an electrode sealed in each of said first and second ends, each of said electrodes having an interior portion extending into the interior of said hollow body and together defining an arc gap with a given distance, and an exterior portion extending outside of said arc tube;

an arc generating and sustaining medium contained within said hollow body;

a transparent outer jacket surrounding said arc tube, at least a part of said exterior portions of said electrodes exiting said outer jacket in a manner to allow connection to an operating circuit; and a low-voltage-pulse starting aid affixed to said outer jacket in a position opposite said arc gap, said low-voltage-pulse starting aid being electrically conductive and having a longitudinal dimension greater than said arc gap.

4. The arc discharge light source of claim 3 wherein said low-voltage-pulse starting aid has at least one electrical connection to said operating circuit.

* * * * *